US011441792B2

(12) United States Patent
Liang et al.

(10) Patent No.: US 11,441,792 B2
(45) Date of Patent: Sep. 13, 2022

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Jiawen Liang, Foshan (CN); Zhisheng Lei, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 461 days.

(21) Appl. No.: 16/498,294

(22) PCT Filed: Sep. 4, 2019

(86) PCT No.: PCT/CN2019/104305

§ 371 (c)(1),
(2) Date: Sep. 26, 2019

(87) PCT Pub. No.: WO2021/022603

PCT Pub. Date: Feb. 11, 2021

(65) Prior Publication Data

US 2021/0332989 A1 Oct. 28, 2021

(30) Foreign Application Priority Data

Aug. 8, 2019 (CN) ..... 201910731627.7
Aug. 8, 2019 (CN) ..... 201921285940.4

(51) Int. Cl.

| | |
|---|---|
| ***F24F 1/031*** | (2019.01) |
| ***F24F 13/20*** | (2006.01) |
| ***F24F 13/32*** | (2006.01) |

(52) U.S. Cl.
CPC ..... *F24F 1/031* (2019.02); *F24F 13/20* (2013.01); *F24F 13/32* (2013.01); *F24F 2221/20* (2013.01)

(58) Field of Classification Search
CPC ..... F24F 1/031; F24F 13/20; F24F 13/32; F24F 2221/20; F24F 1/027
(Continued)

(56) References Cited

U.S. PATENT DOCUMENTS

2018/0080668 A1* 3/2018 Booten ..... F24F 1/32

FOREIGN PATENT DOCUMENTS

CN 205299752 U 6/2016
CN 206860588 U 1/2018
(Continued)

OTHER PUBLICATIONS

World Intellectual Property Organization (WIPO) International Search Report and Written Opinion for PCT/CN2019/104305 dated May 7, 2020 17 Pages.

*Primary Examiner* — Steve S Tanenbaum
(74) *Attorney, Agent, or Firm* — Anova Law Group PLLC

(57) ABSTRACT

A window air conditioner includes a casing including an outdoor part and an indoor part spaced apart from each other. A receiving groove is formed between the outdoor part and the indoor part. The window air conditioner further includes a first positioning portion provided at a side wall of the receiving groove and a fastening device mounted at the casing. The fastening device includes a plurality of second positioning portions spaced apart from each other in a direction from the indoor part to the outdoor part. The fastening device is configured to switch between a locked state and an unlocked state. In the locked state, the fastening device extends into the receiving groove and one of the
(Continued)

plurality of second positioning portions cooperates with the first positioning portion to fix a position of the fastening device. In the unlocked state, the fastening device is outside the receiving groove.

19 Claims, 8 Drawing Sheets

(58) Field of Classification Search
USPC ..... 62/259.1
See application file for complete search history.

(56) References Cited

FOREIGN PATENT DOCUMENTS

| | | | |
|---|---|---|---|
| CN | 109724173 | A | 5/2019 |
| JP | 2003106574 | A | 4/2003 |

* cited by examiner

WINDOW AIR CONDITIONER

CROSS-REFERENCE TO RELATED APPLICATIONS

This application is a National Stage Entry under 35 U.S.C. § 371 of International Application No. PCT/CN2019/104305, filed on Sep. 4, 2019, which claims priority to and benefits of Chinese Patent Application Serial Nos. 201910731627.7 and 201921285940.4, both titled "Window air conditioner" and filed on Aug. 8, 2019 by GD MIDEA AIR-CONDITIONING EQUIPMENT CO., LTD. and MIDEA GROUP CO., LTD., the entire contents of all of which are incorporated herein by reference.

FIELD

The present disclosure relates to a field of air conditioners, and more particularly to a window air conditioner.

BACKGROUND

In the related art, since most of window air conditioners have no structure for fixing a window sash, the window sash needs fixing by many parts after a window air conditioner is installed. Individual mounting structures are needed to stably mount window sashes of different specifications, the mounting structures cannot be employed universally, which means increase in mounting cost and poor economic efficiency. There is room for improvement.

SUMMARY

The present disclosure seeks to solve at least one of the problems existing in the related art to at least some extent. To this end, the present disclosure provides a window air conditioner which achieves stable installation and fixation of window sashes of different specifications with good universality and low cost.

The window air conditioner according to the embodiments of the present disclosure is mounted at a window opening provided with a movable window sash on a wall, and including: a casing comprising an outdoor part and an indoor part spaced apart from each other to form a receiving groove, in which the window sash is arranged in the receiving groove, a side wall of the receiving groove is provided with a first positioning portion; and a fastening device rotatably mounted at the casing and provided with a plurality of second positioning portions spaced apart from each other in a direction from an indoor side to an outdoor side, wherein the fastening device has a locked state and an unlocked state, in the locked state, the fastening device extends into the receiving groove and cooperates with the window sash to fix a position of the window sash, the first positioning portion cooperates with one of the plurality of second positioning portions to fix a position of the fastening device, and in the unlocked state, the fastening device is disengaged from the window sash.

In the window air conditioner according to the embodiment of the present disclosure, the movable fastening device is arranged at the casing, during mounting the window sash, the fastening device moves to abut against the window sash, and then the fastening device is locked with the casing at the position, thereby fixing the window sash. The window air conditioner can be adapted to window sashes of different thicknesses with good universality, to meet mounting needs of the window sashes of different thicknesses, which is beneficial to reduction of mounting cost.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference the accompanying drawings, in which.

Figure 1:
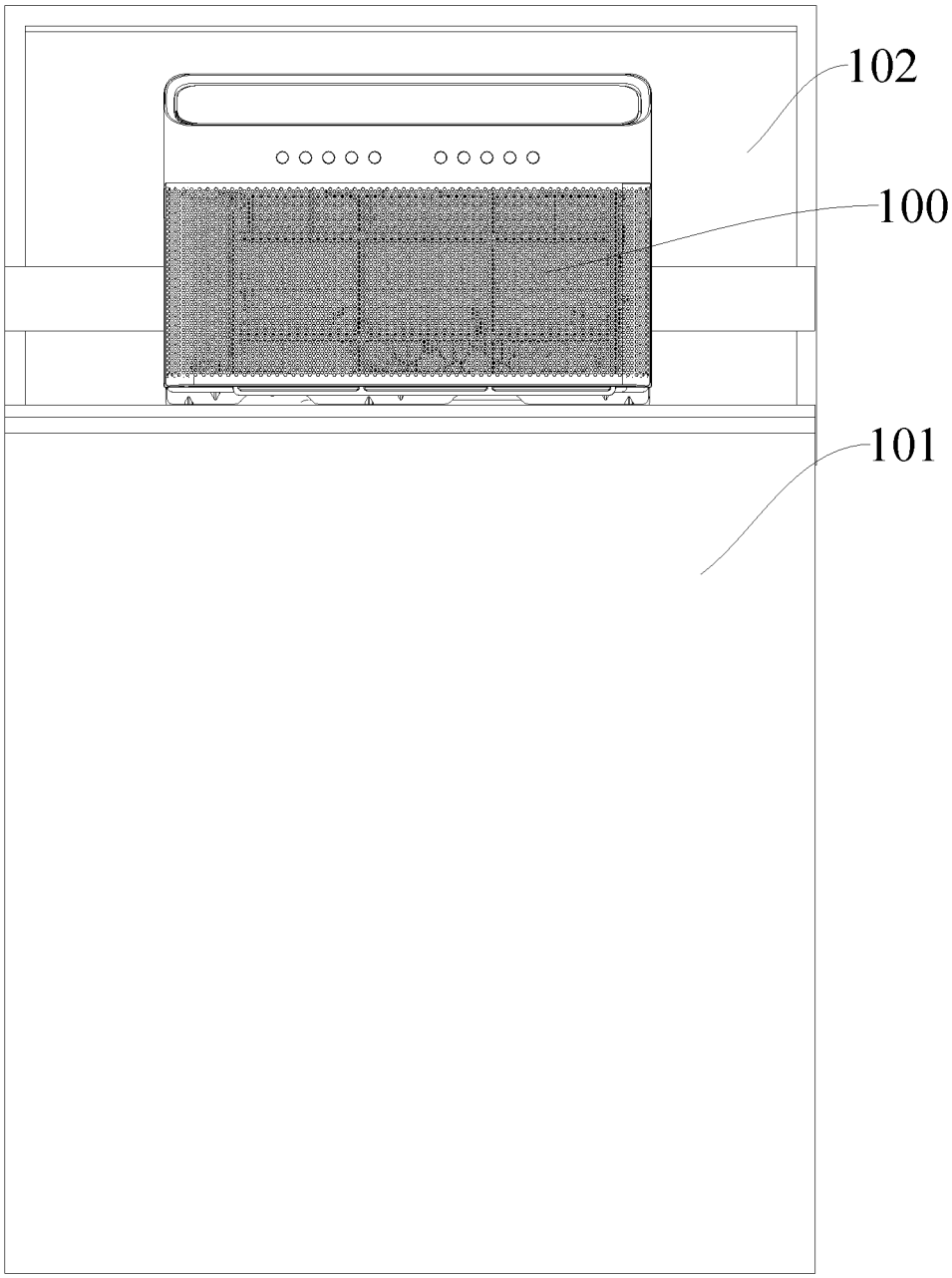
FIG. 1 is a view of a window air conditioner mounted at a wall according to an embodiment of the present disclosure.

REFERENCE NUMERALS window air conditioner 100, casing 1, outdoor part 11, indoor part 12, through slot 121, mounting base 122, mounting hole 1221, mounting passage 1222, guiding surface 1223, through hole 1224, receiving groove 13, elastic protruding portion 131, mounting portion 132, first sub-portion 1321, second sub-portion 1322, third sub-portion 1323, fourth sub-portion 1324, fifth sub-portion 1325, the grasping space 1326, reinforcing plate 1327, fitting protrusion 133, fastening device 2, pivot shaft 21, fastening member 22, snapping groove 221, limiting protrusion 222, handle 223, weight reduction hole 223, tooth 224, first fitting surface 2241, second fitting surface 2242, reference plane 2243, wall 101, the window sash 102, L-shaped groove 1021, light-transmitting plate 1022, edge bar 1023.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

In the specification, unless specified or limited otherwise, relative terms such as "central", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial" and "circumferential" should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure. In addition, features associated with "first" and "second" can indicate or imply that one or more such features are included. In the description of the present invention, the term "a plurality of" means two or more than two, unless specified otherwise.

In the description of the present disclosure, it should be understood that, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Referring to FIG. 1 to FIG. 8, a window air conditioner 100 according to an embodiment of the present disclosure is described in the following. The window air conditioner 100 is provided with a fastening device 2 used to fasten with the window sash 102, such that the window sash 102 is fixed relative to the window air conditioner 100 after the window sash 102 extends into the window air conditioner 100. The fastening device 2 can be adapted to window sashes 102 of different specifications, such that the window sashes 102 can be effectively fixed with a concise structure and good adaptation. It should be noted that, the window sash 102 includes a light-transmitting plate 1022 and an edge bar 1023 located at an edge of the light-transmitting plate 1022.

As illustrated in FIG. 1 to FIG. 4, as for a window air conditioner 100 according to some embodiments of the present disclosure, the window air conditioner 100 is mounted at a window opening on a wall 101, and the window opening is provided with a movable window sash 102. The window air conditioner 100 has a small size and weight, a user can flexibly mount it at a wall 101 of different places according to actual demand, to meet needs in different places where air conditioners are needed.

Figure 2:
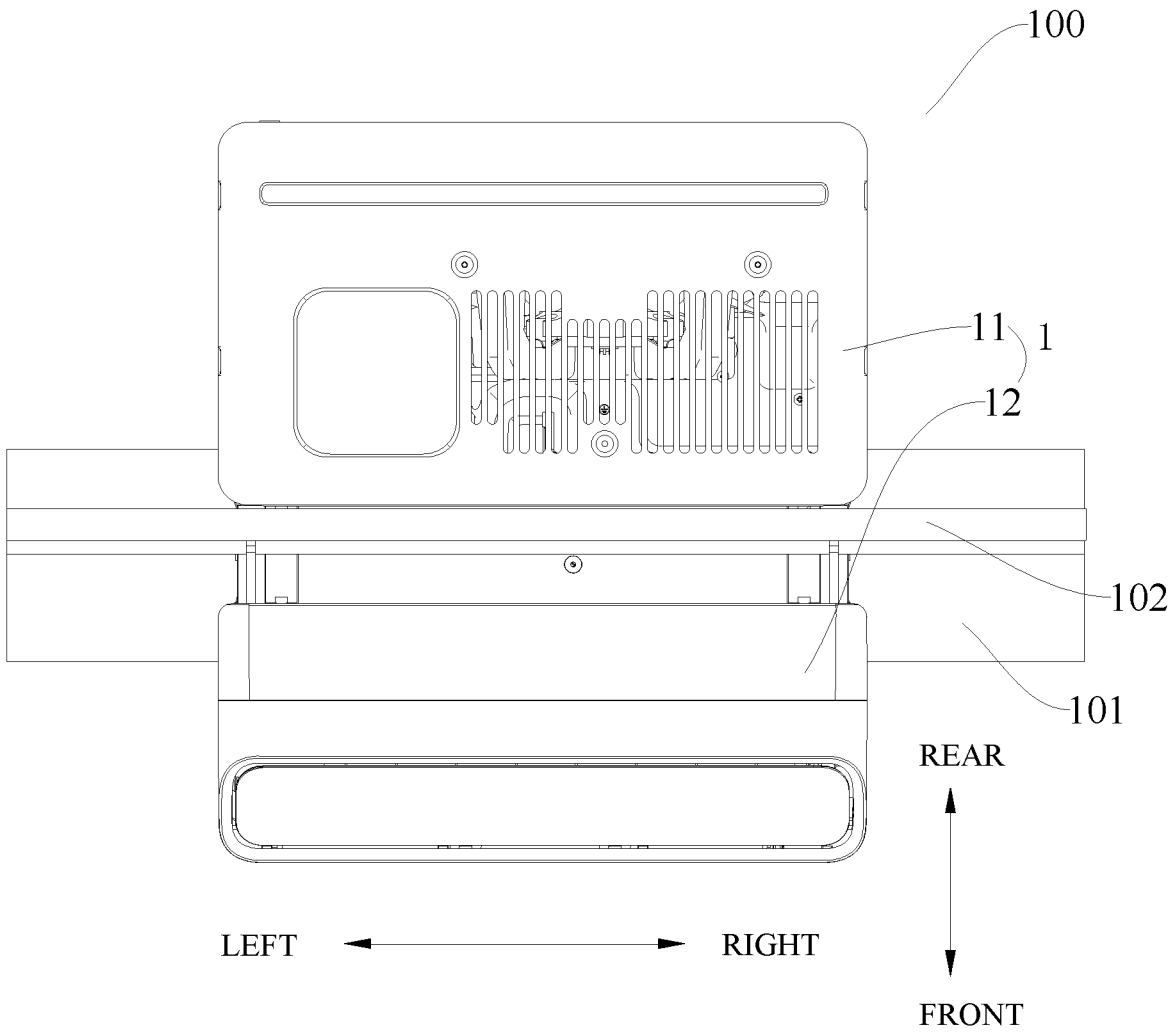
FIG. 2 is a top view of a window air conditioner mounted at a wall according to an embodiment of the present disclosure.
Figure 3:
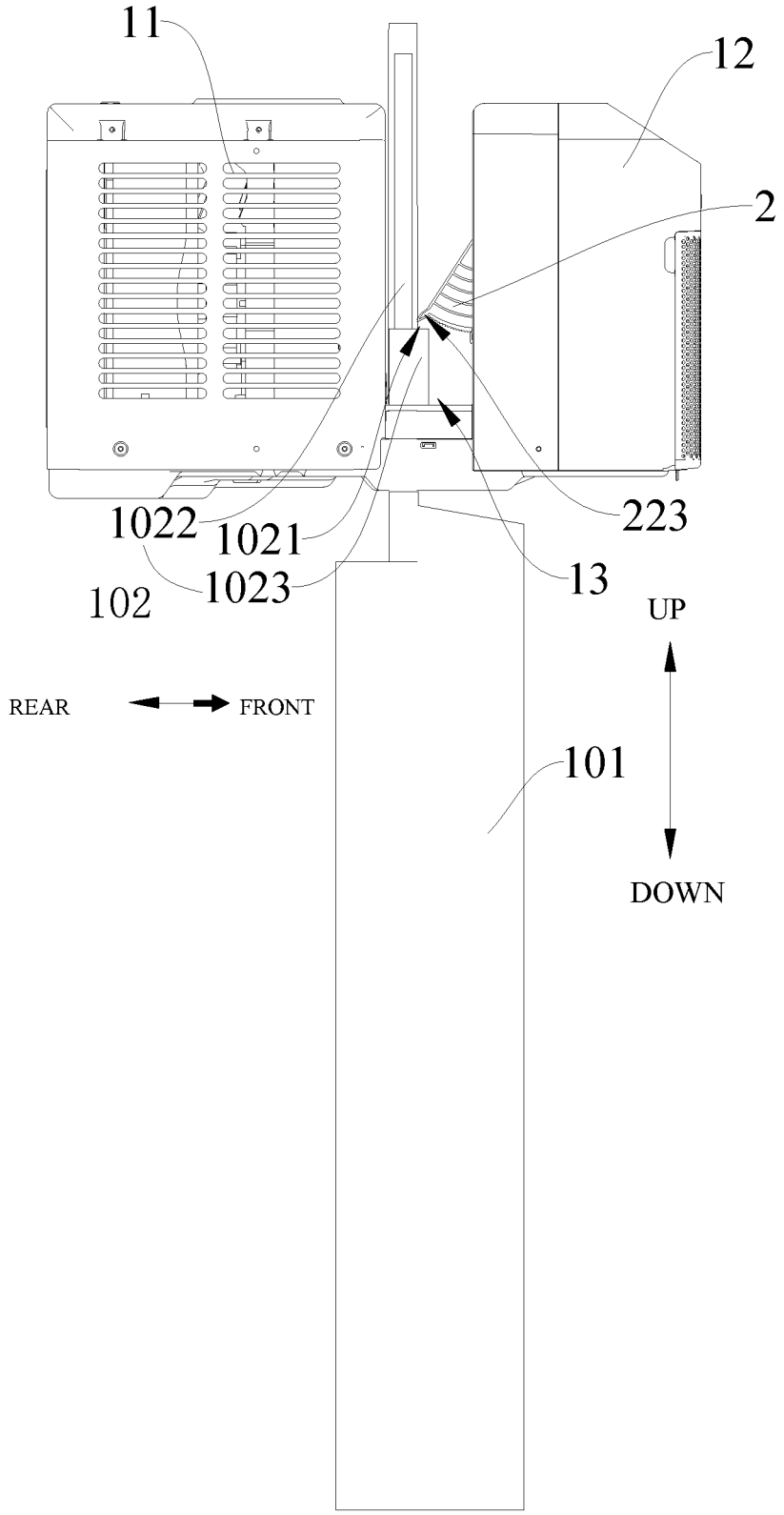
FIG. 3 is a side view of a window air conditioner mounted at a wall according to an embodiment of the present disclosure.
Figure 4:
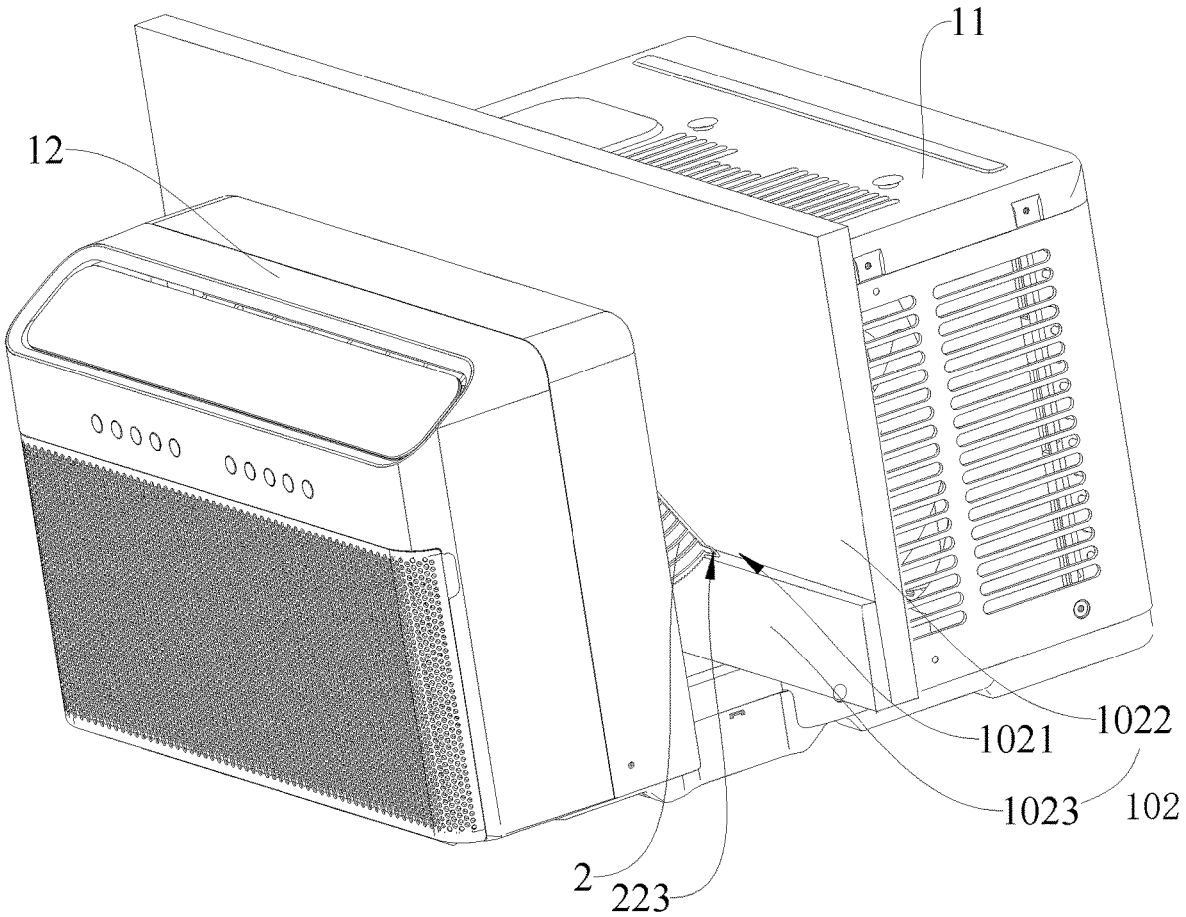
FIG. 4 is a view of fitting between a window air conditioner according to an embodiment of the present disclosure and a window sash.

As illustrated in FIG. 2, the window air conditioner 100 includes a casing 1 and the fastening device 2. As illustrated in FIG. 3, the casing 1 includes an outdoor part 11 and an indoor part 12, the outdoor part 11 is spaced apart from the indoor part 12 to form a receiving groove 13. That is, the outdoor part 11 and the indoor part 12 have side walls facing each other and spaced apart from each other, and the side walls cooperatively define the receiving groove 13, and the window sash 102 can be arranged in the receiving groove 13. It should be noted that, after the window air conditioner 100 is mounted at the window opening, the indoor part 12 and the outdoor part 11 are located at an inner side and outer side of the wall 101 respectively. That means, the indoor part 12 is located in an indoor space for heat exchange with the indoor space, the outdoor part 11 is located in an outdoor space for heat exchange with the outdoor space, and a passage for circulation of a refrigerant is provided between the indoor part 12 and the outdoor part 11.

After the window sash 102 is mounted in the receiving groove 13, the fastening device 2 abuts against the indoor part 12 or the outdoor part 11, such that the window sash 102 can be used for fixing the casing 1, and the window air conditioner 100 can be more stably mounted at the wall 101. Meantime, the receiving groove 13 is open in a width direction of the window opening, i.e., the receiving groove 13 is open in a left-right direction of the window sash 102. When the window sash 102 is pulled down, the window sash 102 can extend into a bottom of the receiving groove 13 without hindrance. With this design, noises from the outdoor part 11 can be effectively insulated, since there are glasses at a left and a right side of the window air conditioner 100, lighting is satisfied in the indoor space.

Figure 6:
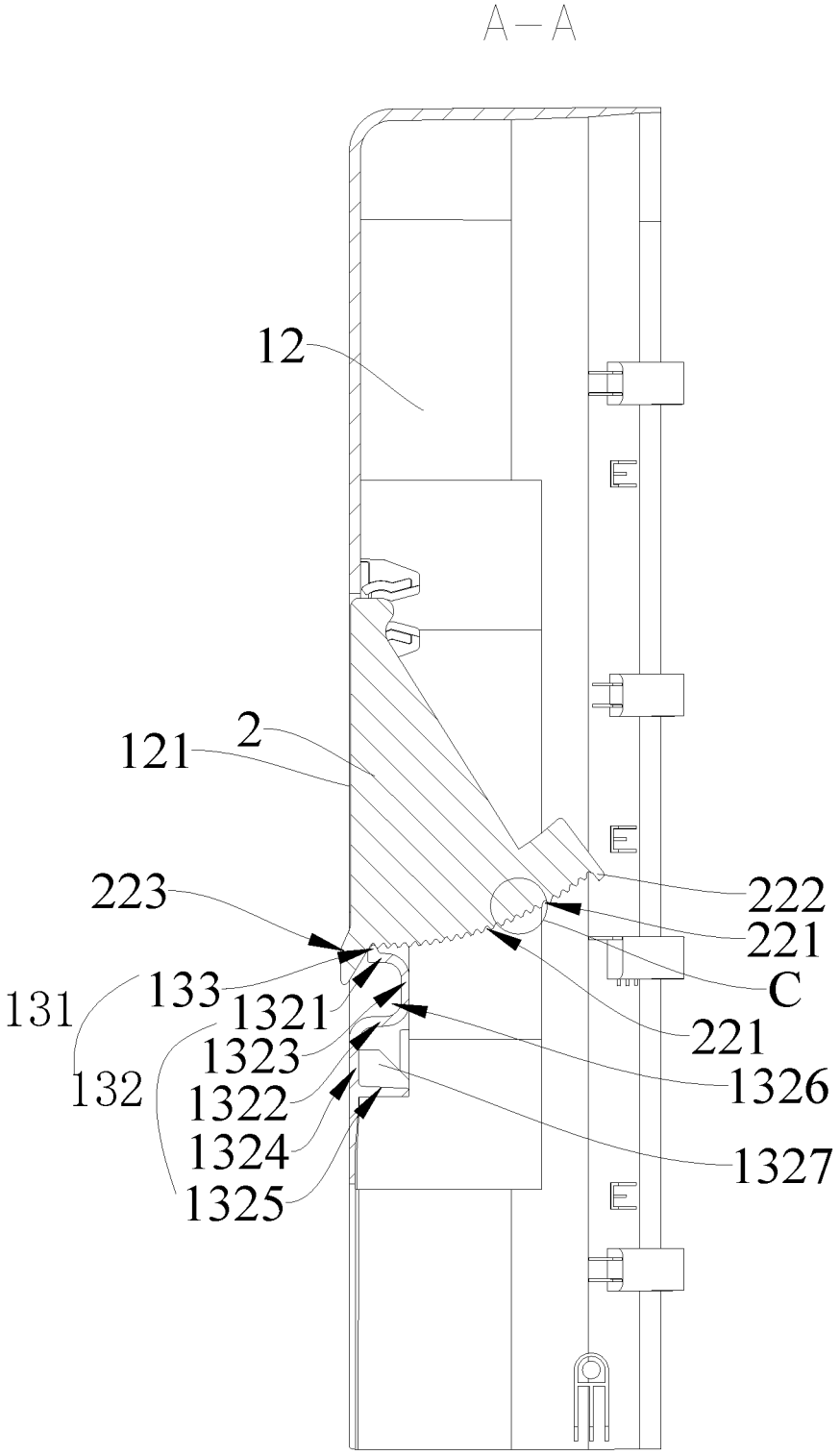
FIG. 6 is a sectional view along line A-A in FIG. 5.

The fastening device 2 is movably arranged at the casing 1. That means the fastening device 2 can be moved relative to the casing 1. The fastening device 2 can be mounted at the indoor part 12 or at the outdoor part 11. As illustrated in FIG. 6, the fastening device 2 is rotatably mounted at the indoor part 12, such that the fastening device 2 can be rotated to different positions relative to the indoor part 12. Certainly, the fastening device 2 can also move linearly relative to the indoor part 12, which also can make the fastening device 2 move to different positions relative to the casing 1.

As illustrated in FIG. 6, a side wall of the receiving groove 13 is provided with a first positioning portion, the fastening device 2 is provided with a plurality of second positioning portions. In a direction from an indoor side to an outdoor side, the plurality of second positioning portions are spaced apart from each other, distances between the plurality of second positioning portions and the side wall of the receiving groove 13 are different, that means distances between the plurality of second positioning portions and the first positioning portion are different.

The fastening device 2 has a locked state and an unlocked state.

In the locked state, the fastening device 2 extends into the receiving groove 13, the first positioning portion cooperates with one of the second positioning portions to fix a position of the fastening device 2, and the fastening device 2 cooperates with the window sash 102 to fix a position of the window sash 102. That means when the fastening device 2 is in the locked state, one of the plurality of second positioning portions of the fastening device 2 cooperates with the first positioning portion on the side wall of the receiving groove 13, such that the fastening device 2 is fixed relative to the casing 1, the position of the fastening device 2 is maintained, thereby ensuring that the window sash 102 is locked.

It should be noted that, when a window sash 102 of different specification (the edge bar 1023 protrudes from the light-transmitting plate 1022 by a different thickness) are mounted, the window sash 102 is mounted in the receiving groove 13 and drives the fastening device 2 to move towards an inner of the receiving groove 13, such that the fastening device 2 constantly moves to the window sash 102, and when the fastening device 2 abuts against the window sash 102, one of the plurality of second positioning portions of the fastening device 2 cooperates with the first positioning portion, therefore the window sash 102 can be fixed.

As illustrated in FIG. 6, the fastening device 2 is rotatably mounted at the indoor part 12, the fastening device 2 is arranged at a side wall of the indoor part 12 adjacent to the outdoor part 11. Therefore, the fastening device 2 can extend into the receiving groove 13 after rotating for a small range, such that the fastening device can be quickly fastened with the window sash 102.

As illustrated in FIG. 6, the fastening device 2 is provided with the plurality of second positioning portions spaced apart from each other along a circumferential direction, the first positioning portion is arranged at an radial outer side of the fastening device 2, and one of the plurality of second positioning portions is just opposite the first positioning portion in a radial direction, and the one second portioning portion is used to lock the first positioning portion in the circumferential direction, such that the fastening device 2 is fixed in the circumferential direction. In this way, after the window sash 102 is mounted in the receiving groove 13, the fastening device 2 can be driven to move towards the outdoor part 11, such that an end of the fastening device 2 facing the inner of the receiving groove 13 in the circumferential direction abuts against the window sash 102, in the meantime, the first positioning portion is locked by the second portioning portion which is just opposite the first positioning portion in the radial direction, the fastening device 2 is fixed, and the fastening device 2 is fastened with the window sash 102.

In the unlocked state, the fastening device 2 moves to a position spaced apart from the window sash 102, such that the fastening device 2 is disengaged from the window sash 102, then the window sash 102 can be dismounted or opened freely, it is convenient for the user to maintain, replace or open.

In this way, for adapting to window sashes 102 of different specifications, the fastening device 2 always abuts against the edge bar 1023 little by little after rotating the fastening device 2 towards the inner of the receiving groove 13 at different angles, and the fastening device 2 can be locked at the position, such that the window sash 102 can be effectively positioned. The fastening device 2 can also be rotated away from the window sash 102, such that the window sash 102 is unlocked, and the usage is convenient. Therefore, all window sashes 102 of different thicknesses can be fixed by the fastening device 2 with good universality. Especially in different places, window sashes 102 are usually different in specification. The window air conditioner 100 can flexibly meet mounting needs of window sashes 102 of different thicknesses in different places, and is good in practicability, which facilitates broadening a market area of the window air conditioner 100.

In the window air conditioner 100 according to the embodiment of the present disclosure, the movable fastening device 2 is arranged at the casing 1, during mounting the window sash 102, the fastening device 2 moves to abut against the window sash 102, and then the fastening device 2 is locked with the casing 1 at the position, thereby fixing the window sash 102. The window air conditioner 100 can be adapted to window sashes 102 of different thicknesses with good universality, to meet mounting needs of the window sashes 102 of different thicknesses, which is beneficial to reduction of mounting cost.

In some embodiments, the first positioning portion is configured as an elastic protruding portion 131, and the second positioning portion is configured as a snapping groove 221. The elastic protruding portion 131 extends into the snapping groove 221 to lock the fastening device 2 with the casing 1. The fastening device 2 is provided with a plurality of teeth 224 along a direction from the indoor side to the outdoor side, the snapping groove 221 is formed between two adjacent teeth 224. The elastic protruding portion 131 can extend into one of snapping grooves 221, such that the position of the fastening device 2 is fixed relative to the casing 1.

Figure 8:
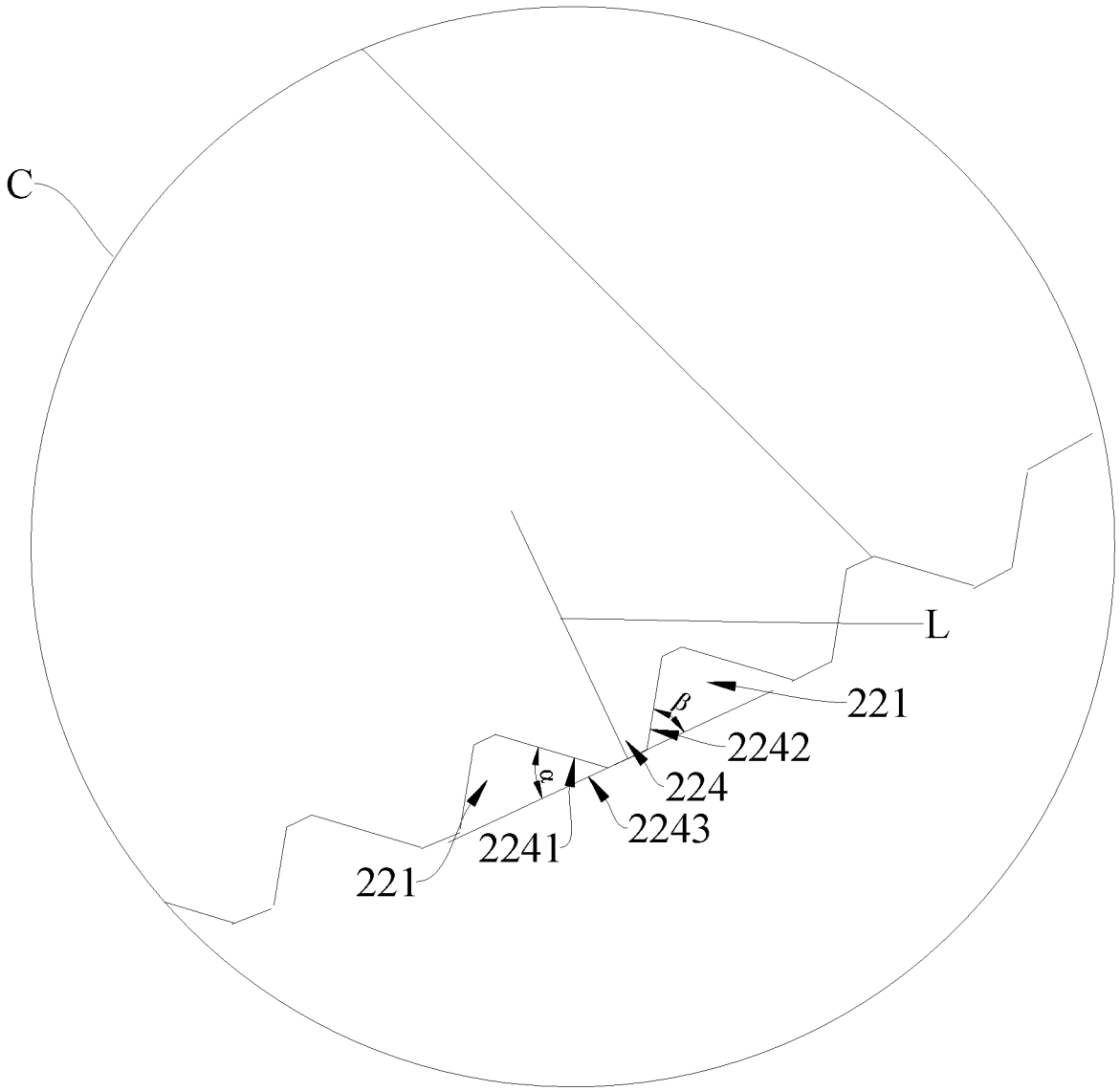
FIG. 8 is an enlarged view of part C in FIG. 6.

As illustrated in FIG. 8, each of the teeth 224 has a first fitting surface 2241 and a second fitting surface 2242, the first fitting surface 2241 faces the receiving groove 13, and the second fitting surface 2242 faces away from the receiving groove 13. As illustrated in FIG. 8, the first fitting surface 2241 and a reference plane 2243 form a first angle α therebetween, the second fitting surface 2242 and the reference plane 2243 form a second angle β therebetween. The reference plane 2243 refers to a plane which is tangential to a top of the corresponding tooth 224, each of the teeth 224 corresponds to one reference plane 2243 respectively. As illustrated in FIG. 8, an auxiliary line L refers to a line parallel to a diameter of the fastening device 2, the reference plane 2243 is perpendicular to the auxiliary line L (that is the reference plane 2243 is tangential to the top of the tooth 224). In this way, when the user drives the fastening device 2 to move to the inner of the receiving groove 13, the first fitting surface 2241 abuts against the elastic protruding portion 131 by driving the fastening device 2 and overcoming a pressure on the first fitting surface 2241 exerted by the elastic protruding portion 131, such that the elastic protruding portion 131 deforms and retracts, then the fastening device 2 moves towards the inner of the receiving groove 1. When the user drives the fastening device 2 to move from the receiving groove 13 to an inner of the casing 1, the second fitting surface 2242 abuts against the elastic protruding portion 131 by driving the fastening device 2 and overcoming a pressure on the second fitting surface 2242 exerted by the elastic protruding portion 131, such that the elastic protruding portion 131 deforms and retracts, then the fastening device 2 moves towards the inner of the casing 1.

As illustrated in FIG. 8, the first angle α is smaller than the second angle β, in this way, when the fastening device 2 are driven to move towards different directions, a positive pressure on the first fitting surface 2241 exerted by the elastic protruding portion 131 is different from a positive pressure on the second fitting surface 2242 exerted by the elastic protruding portion 131. The positive pressure on the first fitting surface 2241 exerted by the elastic protruding portion 131 is less than the positive pressure on the second fitting surface 2242 exerted by the elastic protruding portion 131. A resistance generated when the fastening device 2 moves towards the inner of the receiving groove 13 is less than a resistance generated when the fastening device 2 moves towards the inner of the casing 1. Therefore, the user can rotate the fastening device 2 into the receiving groove 13 to fix the window sash 102 easily, and after the fastening device 2 is fixed with the window sash 102, the fastening device 2 cannot return into the casing 1 from the receiving groove 13, which enhance stability of supporting between the fastening device 2 an the window sash 102.

In some embodiments, the first angle α is within a range from 40° to 50°, and the second angle is within a range from 55° to 65°, for example, the first angle α is 45°, and the second angle β is 60°. Therefore, the user can rotate the fastening device 2 into the receiving groove 13 more easily, and the fastening device 2 can be prevented from entering the casing 1 automatically, improving stability and reliability of the window air conditioner 100.

As illustrated in FIG. 6, the fastening device 2 as a whole is fan-shaped, the fastening device 2 is rotatably connected to the indoor part 12 at a center of a circle of the fastening device 2, such that the fastening device 2 can rotate about an axis thereof. As illustrated in FIG. 6, the plurality of snapping grooves 221 are formed at an outer peripheral wall of the fastening device 2, the elastic protruding portion 131 is arranged at the radial outer side of the fastening device 2, and the elastic protruding portion 131 protrudes towards the fastening device 2, the elastic protruding portion 131 can elastically stretches and retracts along a radial direction of the fastening device 2. When naturally stretching (without tensile force), the elastic protruding portion 131 can extend into the snapping groove 221. When the elastic protruding portion 131 retracts, the elastic protruding portion 131 can escape from the snapping groove 221. Therefore, when the fastening device 2 rotates to abut against the window sash 102, the elastic protruding portion 131 extends into one of the plurality of snapping grooves 221, such that the fastening device 2 is locked in the circumferential direction, such that the fastening device 2 always abuts against the window sash 102.

It should be noted that, an end of the elastic protruding portion 131 facing the fastening device 2 is a tip, and the snapping groove 221 is an opening in the whole. In this way, when a driving force is exerted on the fastening device 2, a wall of the opening abuts against the elastic protruding portion 131, such that the elastic protruding portion 131 retracts, therefore the elastic protruding portion 131 escapes from the snapping groove 221, and the fastening device 2 can rotate to other position along the circumferential direction, it is convenient to rotate the fastening device 2 to a position at which the fastening device abuts against the window sash 102, or to a position at which the fastening device is spaced apart from the window sash 102. The fastening device 2 can be switched between the locked state and the unlocked state, improving rationality of structural design of the window air conditioner 100.

Certainly, locking manner between the fastening device 2 and the casing 1 is not limited, that is the fastening device 2 and the casing 1 can be locked in other manners. For example, the fastening device 2 is provided with a plurality of positioning columns spaced apart from each other along the circumferential direction, the casing 1 includes a locking hole for fitting with one of the plurality of positioning columns, which also can lock the fastening device 2 with the casing 1.

As illustrated in FIG. 6, the first positioning portion includes a mounting portion 132 and a fitting protrusion 133.

The fitting protrusion 133 is arranged at an upper surface of the mounting portion 132. As illustrated in FIG. 6, the fitting protrusion 133 protrudes towards the fastening device 2, the fitting protrusion 133 can extend into the snapping groove 221, such that the first positioning portion can be fixed to the fastening device 2 along the circumferential direction, the fitting protrusion 133 is a tip (taper), and an inner wall of the snapping groove 221 can press on the fitting protrusion 133, such that the first positioning portion deforms and retracts.

The mounting portion 132 is arranged at the casing 1, an end of the mounting portion 132 away from the fitting protrusion 133 is connected to the casing 1. As illustrated in FIG. 6, the mounting portion 132 has a lower end fixed connected to the indoor part 12, the mounting portion 132 is an elastic member, that is the mounting portion 132 deforms along a length direction thereof. In this way, when the fitting protrusion 133 is pressed, the mounting portion 132 deforms, such that the fitting protrusion 133 escapes from the snapping groove 221, and when the fitting protrusion 133 is just opposite the snapping groove 221, the mounting portion 132 stretches due to its own elastic force, such that the fitting protrusion 133 extends into the snapping groove 221 to be fixed with the fastening device 2 along the circumferential direction, the fastening device 2 can be locked and unlocked.

An end portion of the fastening device 2 facing the receiving groove 13 is provided with a handle 223, as illustrated in FIG. 6, the handle 223 extends outwards along the radial direction of the fastening device 2 and leans away the tooth 224, the handle 223 can be used to drive the fastening device 2 to move relative to the casing 1, such that the fastening device 2 can protrude or return quickly. After the fastening device 2 extends into the receiving groove 13, the handle 223 has a free end abutting against the window sash 102, such that relative positions among the window sash 102, the fastening device 2, and the casing 1 are fixed. Therefore, with the handle 223 on the end portion of the fastening device 2, the user can directly drive the handle 223 to enable the fastening device 2 to protrude quickly, the structure is simple and operation is convenient. The handle 223 abuts against the window sash 102, which improve stability of installation of the window sash 102.

The mounting portion 132 includes a grasping space 1326 at a side adjacent to the handle 223. As illustrated in FIG. 6, the grasping space 1326 is located below the handle 223, and the grasping space 1326 is open towards the inner of the receiving groove 13. In this way, when the user needs to drive the fastening device 2 to move towards the inner of the receiving groove 13, the user can stretches his hand into the grasping space 1326 to contact a side of the handle 223 away from the receiving groove, and further driving the handle 223 and the whole the fastening device 2 to move towards the inner of the receiving groove 13, the structure is simple and convenient for the user to operate, making it easy for the user to drive the fastening device 2 from the inner of the casing 1 into the receiving groove 13, the practicability is good.

As illustrated in FIG. 3, the window sash includes a light-transmitting plate 1022 and an edge bar 1023, the edge bar 1023 is located at an edge of the light-transmitting plate 1022, and the light-transmitting plate 1022 and the edge bar 1023 form an L-shaped groove 1021 therebetween. As illustrated in FIG. 3, the handle 223 has a snapping tip at a terminal end, the snapping tip is used for snapping into the L-shaped groove 1021. In this way, after the fastening device 2 extends into the receiving groove 13, the snapping tip of the handle 223 is snapped into the L-shaped groove 1021 to fix the position of the window sash 102, thereby mounting the window sash 102 on the casing 1.

Specifically, during locking the window sash 102, the window sash 102 is firstly put in the receiving groove 13, then the user stretches his hand into the grasping space 1326 and moves the handle 223, such that the handle 223 and the whole fastening device 2 move towards the inner of the receiving groove 13, after the snapping tip of the handle 223 extends into the L-shaped groove 1021, the fastening device 2 and the casing 1 are locked, the fastening device 2 locks the window sash 102 in the receiving groove 13, such that the window sash 102 is stably mounted at the casing 1. During opening the window sash 102, the user stretches his hand into the receiving groove 13 and presses the side of the handle 223 away from the tooth 224, such that the handle 223 is pressed to drive the fastening device 2 to rotate into the casing 1 little by little, and after the snapping tip of the handle 223 escapes from the L-shaped groove 1021 of the window sash, the user can open the window sash 102 freely.

As illustrated in FIG. 6, the mounting portion 132 includes a first sub-portion 1321, a second sub-portion 1322, a third sub-portion 1323, a fourth sub-portion 1324 and a fifth sub-portion 1325.

The first sub-portion 1321 is spaced apart from the second sub-portion 1322 in an up-down direction, and the first sub-portion 1321 is located above the second sub-portion 1322. The fitting protrusion 133 is arranged at the first sub-portion 1321 at the upper position, and the fitting protrusion 133 protrudes away from the second sub-portion 1322.

As illustrated in FIG. 6, the first sub-portion 1321 is parallel to and spaced apart from the second sub-portion 1322, the third sub-portion 1323 is perpendicular to the first sub-portion 1321 and the second sub-portion 1322, the third sub-portion 1323 has an upper end and a lower end connected to a first end of the first sub-portion 1321 and a first end of the second sub-portion 1322 respectively, that is the upper end of the third sub-portion 1323 is connected to the first sub-portion 1321, the upper end of the third sub-portion 1323 is connected to the end of the first sub-portion 1321 away from the fitting protrusion 133, and the first end of the second sub-portion 1322 is connected to the lower end of the third sub-portion 1323. With this design, the mounting portion 132 can elastically deform and has the grasping space 1326. As illustrated in FIG. 6, the upper end of the third sub-portion 1323 is connected to the end of the first sub-portion 1321 away from the receiving groove 13, the lower end of the third sub-portion 1323 is connected to the end of the second sub-portion 1322 away from the receiving groove 13. The first sub-portion 1321, the second sub-portion 1322, and the third sub-portion 1323 together form the grasping space 1326, therefore, the user can stretches his finger between the first sub-portion 1321 and the second sub-portion 1322 to drive the handle 223.

An arc transition segment is provided at connection between the first sub-portion 1321 and the third sub-portion 1323, and another arc transition segment is provided at connection between the second sub-portion 1322 and the third sub-portion 1323, therefore, connection stresses at the connection between the first sub-portion 1321 and the third sub-portion 1323, and at the connection between the second sub-portion 1322 and the third sub-portion 1323 can be reduced, breakage at connection between the first sub-portion 1321 and the second sub-portion 1322 and breakage at connection between the second sub-portion 1322 and the third sub-portion 1323 due to overlarge stress on the first sub-portion 1321 can be prevented.

It should be understood that, during driving the fastening device 2 to rotate, the inner wall of the snapping groove 221 presses the fitting protrusion 133, the fitting protrusion 133 drives the first sub-portion 1321 to move downwards. As illustrated in FIG. 6, the fitting protrusion 133 is arranged at the end of the first sub-portion 1321 away from the third sub-portion 1323, which makes the first sub-portion 1321 drive the third sub-portion 1323 to bend and deform when the first sub-portion 1321 moves downwards, the first sub-portion 1321 moves towards the second sub-portion 1322, the fitting protrusion 133 escapes from the snapping groove 221, and the fastening device 2 is unlocked. When the fastening device 2 rotates and the fitting protrusion 133 is just opposite the snapping groove 221, the third sub-portion 1323 recovers deformation and drives the first sub-portion 1321 to move away from the second sub-portion 1322, such that the fitting protrusion 133 extends into the snapping groove 221, and the fastening device 2 is locked. During driving rotation of the fastening device 2, the fitting protrusion 133 moves from one of the snapping grooves 221 to another one of the snapping grooves 221 successively.

As illustrated in FIG. 6, the fourth sub-portion 1324 is arranged at the casing 1, the fourth sub-portion 1324 is fixed relative to the casing 1, the fourth sub-portion 1324 is connected to a second end of the second sub-portion 1322, and the fourth sub-portion 1324 and the third sub-portion 1323 extend in opposite directions. As illustrated in FIG. 6, the third sub-portion 1323 and the fourth sub-portion 1324 are connected to two ends of the second sub-portion 1322 respectively, the third sub-portion 1323 extends upwards from the first end of the second sub-portion 1322, and the fourth sub-portion 1324 extends downwards from the second end of the second sub-portion 1322.

The fifth sub-portion 1325 is connected to a lower end of the fourth sub-portion 1324, and the fifth sub-portion 1325 is spaced apart from the second sub-portion 1322. As illustrated in FIG. 6, the first sub-portion 1321, the second sub-portion 1322 and the fifth sub-portion 1325 are spaced apart from each other along an up-down direction, that means the second sub-portion 1322 is located between the first sub-portion 1321 and the fifth sub-portion 1325, the third sub-portion 1323 is connected between the first sub-portion 1321 and the second sub-portion 1322, and the fourth sub-portion 1324 is connected between the second sub-portion 1322 and the fifth sub-portion 1325. As illustrated in FIG. 6, a side of the third sub-portion 1323 away from the fitting protrusion 133 abuts the casing 1, and a lower surface of the fifth sub-portion 1325 abuts the casing 1.

In this way, when the fitting protrusion 133 is pressed, the first sub-portion 1321 and the second sub-portion 1322 both move downwards, and the third sub-portion 1323 bend and move downwards. Therefore, deformation of the mounting portion 132 can be enlarged, and the rigidity of the mounting portion 132 in the up-down direction can be reduced, such that the mounting portion 132 deforms in time when the fitting protrusion 133 is under force, thereby accelerating a response speed of the elastic protruding portion 131, making it easy to quickly install the window air conditioner 100, and increasing installation efficiency. As illustrated in FIG. 6, a reinforcing plate 1327 is provided between the fifth sub-portion 1325 and the fourth sub-portion 1324, the reinforcing plate 1327 can enhance intensity of connection between the fifth sub-portion 1325 and the fourth sub-portion 1324, prevent overlarge deformation of the mounting portion 132, and improving structural stability of the mounting portion 132. The mounting portion 132 and the casing 1 are an integrally formed member, that means all the first sub-portion 1321, the second sub-portion 1322, the third sub-portion 1323, the fourth sub-portion 1324, and the fifth sub-portion 1325 are integrally formed with the casing 1. The mounting portion 132 cannot be easily disengaged from the casing 1, it can be ensured that the mounting portion 132 is always in a stable operation state, such that the fitting protrusion 133 can effectively lock the fastening device 2. Therefore, the mounting portion 132 has large structural intensity at each bent, fracture due to bend will not occur easily, the service life of the mounting portion 132 can be prolonged, and long-term use can be achieved. With the integrally formed member, steps for installation can be reduced, and the installation efficiency can be raised.

In some embodiments, as illustrated in FIG. 6, the fastening device 2 includes a recess, the plurality of second positioning portions are arranged at a bottom wall of the recess, the first positioning portion extends into the recess to be fitted with one of the second positioning portions.

As illustrated in FIG. 6, the recess is formed in an outer peripheral wall of the fastening device 2, that is the recess retracts inwards along the radial direction of the fastening device 2, a first end of the recess is provided with the above mentioned handle 223, and a second end of the recess is provided with the limiting protrusion 222, that means the handle 223 and the limiting protrusion 222 are spaced apart from each other along the circumferential direction and arranged at the outer peripheral wall of the fastening device 2. It should be noted that, the handle 223 and the limiting protrusion 222 both protrudes from the outer peripheral wall of the fastening device 2, when the mounting portion 132 retracts furthest, the fitting protrusion 133 is stilled located in the recess and cannot pass over the limiting protrusion 222 or the handle 223 and move to the outside of the recess. In this way, the fitting protrusion 133 is always located in the recess and fitted with one of the plurality of snapping grooves 221, to prevent the fitting protrusion 133 from escaping from the recess. Therefore, it is can be ensured that the fastening device 2 rotates within a safe and reasonable range.

In some embodiments, the casing 1 is provided with a mounting base 122. As illustrated in FIG. 6, the mounting base 122 is arranged at the indoor part 12, and the mounting base 122 is arranged at a side of the indoor part 12 adjacent to the outdoor part 11, the mounting base 122 is used to movably cooperate with the fastening device 2, such that the fastening device 2 can move relative to the indoor part 12.

Figure 7:
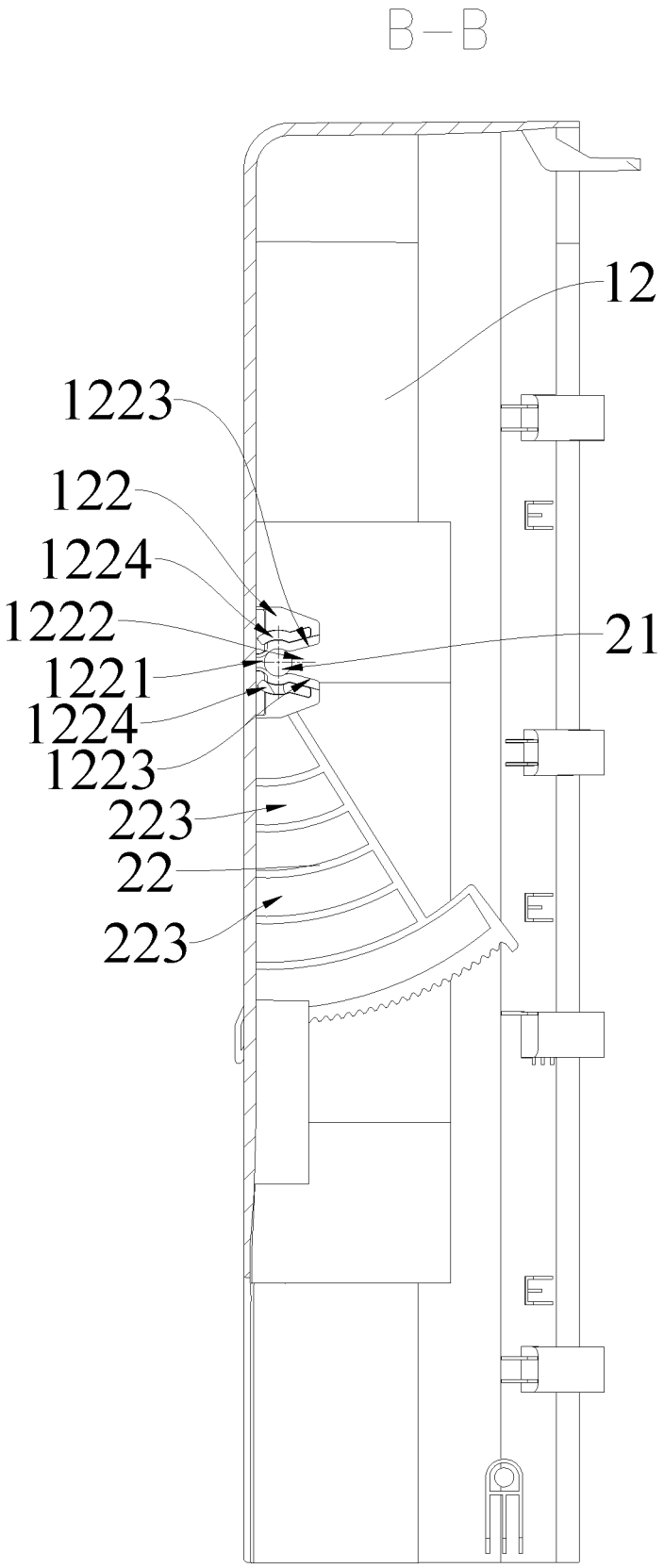
FIG. 7 is a sectional view along line B-B in FIG. 5.

As illustrated in FIG. 7, the fastening device 2 includes a pivot shaft 21 and a fastening member 22.

The pivot shaft 21 is rotatably arranged at the mounting base 122, that means the pivot shaft 21 can rotate relative to the mounting base 122. The fastening member 22 is connected to the pivot shaft 21 to rotate relative to the casing 1. The fastening member 22 may be fixedly connected to the pivot shaft 21 to form an integral member, or they can be integrally formed. As illustrated in FIG. 7, the fastening member 22 includes a plurality of weight reduction holes 223 spaced apart from each other along the radial direction and extending along the circumferential direction, such that the fastening member 22 has a light structure.

As illustrated in FIG. 6, the fastening member 22 has a fan shape, and an axis of the pivot shaft 21 passes a center of a circle of the fastening member 22, the second positioning portions are arranged at the fastening member 22, the second positioning portions are configured as the snapping grooves 221 at the outer peripheral wall of the fastening member 22. In this way, during rotation of the fastening member 22 relative to the mounting base 122, one of the plurality of snapping grooves 221 can be locked by the fitting protrusion 133. Different snapping grooves 221 can be locked by the fitting protrusion 133 by driving the fastening member 22 to rotate, such that the fastening member 22 always can be rotated to abut against the window sash 102 for mounting window sashes 102 of different thicknesses.

The mounting base 122 is configured as an elastic member. That means the mounting base 122 can elastically deform under a large pressure, the mounting base 122 includes a mounting hole 1221, and the pivot shaft 21 is in contact with an inner wall of the mounting hole 1221.

In this way, during rotation of the fastening device 2, an inner wall of the snapping groove 221 abuts against the fitting protrusion 133, then the fitting protrusion 133 drives the mounting portion 132 to deform downwards, the fastening member 22 abuts against an upper surface of the inner wall of the mounting hole 1221 by means of the pivot shaft 21, such that the mounting portion 132 and the mounting base 122 both elastically deform. Therefore, the fitting protrusion 133 can be disengaged from the snapping groove 221 quickly, such that the fastening device 2 can rotate more quickly. When the position of the fastening device 2 is fixed after rotation, the upper surface of the inner wall of the mounting hole 1221 abuts against the pivot shaft 21, such that the fastening member 22 move downwards, the snapping groove 221 quickly locks the fitting protrusion 133, raising installation efficiency.

As illustrated in FIG. 6, the mounting base 122 is provided with a mounting passage 1222, the mounting passage 1222 is in communication with the mounting hole 1221, the pivot shaft 21 is mounted in the mounting hole 1221 through the mounting passage 1222. In this way, the mounting hole 1221 and the mounting passage 1222 together form a receiving space for mounting the pivot shaft 21, the receiving space has an opening, such that the pivot shaft 21 can be mounted in and taken out from the mounting hole 1221 through the opening, thereby making it convenient to mount and dismount the pivot shaft 21 and the fastening member 22.

As illustrated in FIG. 6, a minimum distance between an upper surface and lower surface of the mounting passage 1222 is less than a diameter of the pivot shaft 21. In this way, when the pivot shaft 21 is mounted, the pivot shaft 21 opens the mounting passage 1222 and enters the mounting hole 1221, after the pivot shaft 21 enters the mounting hole 1221, the mounting passage 1222 recovers deformation, such that the pivot shaft 21 is stably mounted in the mounting hole 1221, and the mounting passage 1222 can limit the pivot shaft 2 from moving to the opening, such that the pivot shaft 21 can be prevented from automatically falling out from a pivot shaft, and the fastening device 2 can stably move.

As illustrated in FIG. 6, at least one of opposite walls of the mounting passage 1222 includes a guiding surface 1223, the guiding surface 1223 obliquely extends towards the mounting hole 1221, the guiding surface 1223 is used for guiding the pivot shaft 21 to the mounting hole 1221. The guiding surface 1223 may be arranged at an upper side wall of the mounting passage 122 or at a lower side wall of the mounting passage 1222. Or as illustrated in FIG. 6, both the upper side wall and the lower side wall of the mounting passage 1222 include guiding surfaces 1223, to form a bell-mouthed opening of the mounting passage 1222, such that the pivot shaft 21 can be quickly mounted in the mounting hole 1221, or the pivot shaft 21 can be quickly taken out.

The mounting base 122 includes a hollowed-out area. As illustrated in FIG. 7, the mounting base 122 includes through holes 1224 running along an axis direction of the mounting hole 1221 at an upper portion and a lower portion. With the hollowed-out area, the mounting passage 1222 can quickly deform and be opened when the pivot shaft 21 is mounted, such that the pivot shaft 21 can be quickly mounted, material for manufacturing the mounting base 122 can be reduced, the whole weight of the mounting base 122 can be lowered, and the whole weight and cost of the window air conditioner 100 can be lowered.

Figure 5:
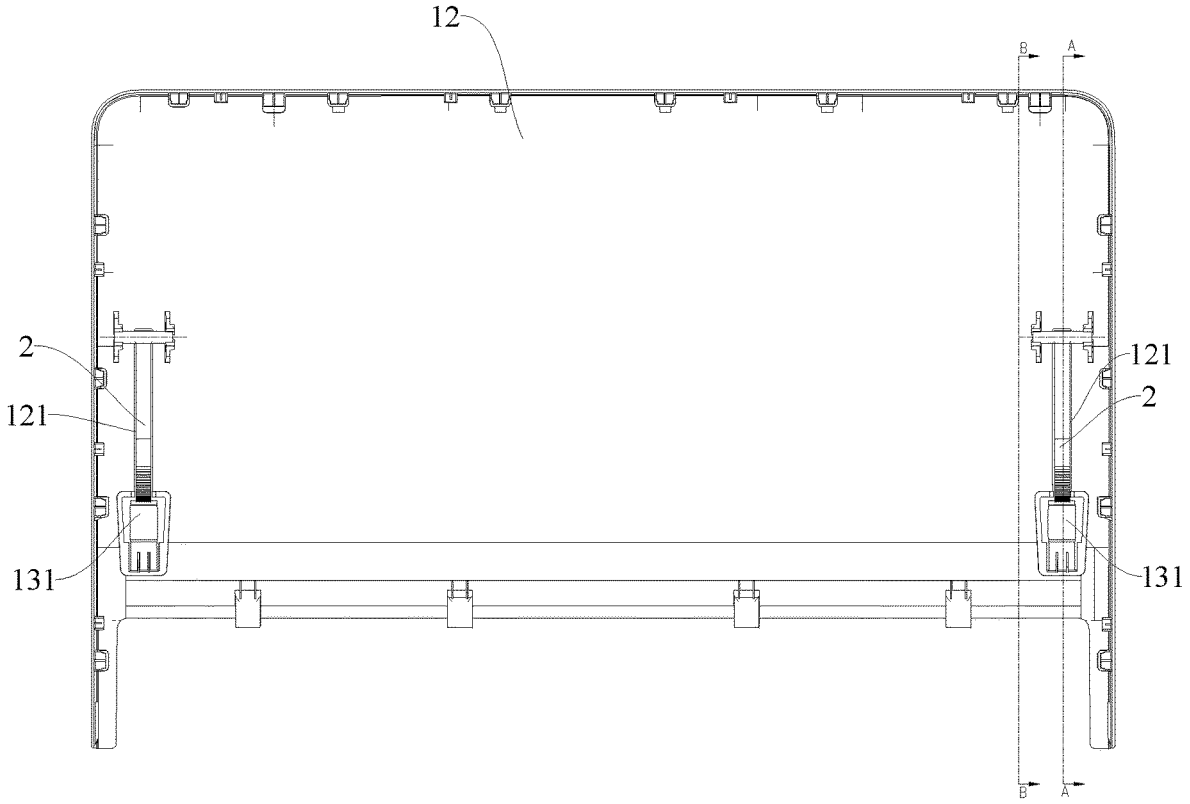
FIG. 5 is a view of an inner structure of an indoor part of a window air conditioner according to an embodiment of the present disclosure.

As illustrated in FIG. 5, two mounting bases 122 are provided and spaced apart from each other, each of the mounting bases 122 includes a mounting hole 1221, and two ends of the pivot shaft 21 are fitted with mounting holes 1221 at corresponding sides respectively. In this way, the two ends of the pivot shaft 21 can be stably supported, such that the fastening member 22 and the pivot shaft 21 maintain in a stable state during rotation, a rotating axis of the fastening member 22 will not lean, the fitting protrusion 133 can be effectively locked by the snapping groove 221.

In some embodiments, the indoor part 12 includes a through slot 121, the through slot 121 is at the side of the indoor part 12 facing the outdoor part 11, and the through slot 121 is open at a side facing the outdoor part 11, the fastening member 22 can be rotated from the inner of the indoor part 12 to the inner of the receiving groove 13 through the through slot 121, or can be rotated from the inner of the receiving groove 13 to the inner of the indoor part 12 through the through slot 121. During rotation of the fastening member 22, the through slot 121 makes room for the fastening member 22.

When the fastening device 2 is in the unlocked state, the fastening member 22 is located in the through slot 121 to enclose the through slot 121, that means the fastening member 22 does not extend into the receiving groove 13 and is spaced apart from the window sash 102, such that the window sash 102 can be put in or taken out smoothly. When the fastening device 2 is not used to fasten the window, the fastening device 2 encloses the through slot 121, and the indoor part 12 has an integral whole structure.

When the fastening device 2 is in the locked state, the fastening member 22 rotates to the outside of the through slot 121 to fix the position of the window sash 102, that means the fastening member 22 extends into the receiving groove 13 to abut against the window sash 102, such that the position of the window sash 102 in the receiving groove 13 is fixed, and the window sash 102 and the casing 1 support each other.

The window air conditioner according to the embodiments of the present disclosure is mounted at a window opening provided with a movable window sash on a wall, and comprising: a casing comprising an outdoor part and an indoor part spaced apart from each other to form a receiving groove, wherein the window sash is arranged in the receiving groove, a side wall of the receiving groove is provided with a first positioning portion; and a fastening device rotatably mounted at the casing and provided with a plurality of second positioning portions spaced apart from each other in a direction from an indoor side to an outdoor side, wherein the fastening device has a locked state and an unlocked state, in the locked state, the fastening device extends into the receiving groove and cooperates with the window sash to fix a position of the window sash, the first positioning portion cooperates with one of the plurality of second positioning portions to fix a position of the fastening device, and in the unlocked state, the fastening device is disengaged from the window sash.

In some embodiments of the present disclosure, the first positioning portion is configured as an elastic protruding portion, the second positioning portion is configured as a snapping groove, and the elastic protruding portion is snapped into the snapping groove.

In some embodiments of the present disclosure, the fastening device is provided with a plurality of teeth along the direction from the indoor side to the outdoor side, and the snapping groove is formed between two adjacent teeth.

In some embodiments of the present disclosure, each of the teeth has a first fitting surface and a second fitting surface, the first fitting surface faces the receiving groove, the second fitting surface faces away from the receiving groove, the first fitting surface and a reference plane form a first angle therebetween, the second fitting surface and the reference plane form a second angle therebetween, and the reference plane refers to a plane which is tangential to a top of a corresponding tooth.

In some embodiments of the present disclosure, the first positioning portion comprises a mounting portion and a fitting protrusion, the fitting protrusion is arranged at an upper surface of the mounting portion, the mounting portion is arranged at the casing and configured as an elastic member.

In some embodiments of the present disclosure, an end portion of the fastening device facing the receiving groove is provided with a handle, and the fastening device is driven to move relative to the casing by means of the handle.

In some embodiments of the present disclosure, the mounting portion includes a grasping space at a side adjacent to the handle.

In some embodiments of the present disclosure, the window sash comprises a light-transmitting plate and an edge bar, the handle has a snapping tip at a terminal end, and the snapping tip is used to be snapped into an L-shaped groove formed between the light-transmitting plate and the edge bar.

In some embodiments of the present disclosure, the mounting portion comprises: a first sub-portion and a second sub-portion spaced apart from each other in an up-down direction, wherein the fitting protrusion is arranged at the first sub-portion at an upper position; and a third sub-portion having an upper end and a lower end connected to a first end of the first sub-portion and a first end of the second sub-portion respectively.

In some embodiments of the present disclosure, the mounting portion and the casing are an integrally formed member.

In some embodiments of the present disclosure, the fastening device includes a recess, the plurality of second positioning portions are arranged at a bottom wall of the recess, and the first positioning portion extends into the recess to be fitted with one of the second positioning portion.

In some embodiments of the present disclosure, the fastening device is arranged at a side wall of the indoor part adjacent to the outdoor part.

In some embodiments of the present disclosure, the casing is provided with a mounting base, the fastening device comprises: a pivot shaft rotatably arranged at the mounting base; and a fastening member connected to the pivot shaft to rotate relative to the casing and provided with the second positioning portions.

In some embodiments of the present disclosure, the mounting base is configured as an elastic member and includes a mounting hole, and the pivot shaft is in contact with an inner wall of the mounting hole.

In some embodiments of the present disclosure, the mounting base is provided with a mounting passage in communication with the mounting hole, and the pivot shaft is mounted in the mounting hole through the mounting passage.

In some embodiments of the present disclosure, at least one of opposite walls of the mounting passage includes a guiding surface obliquely extending towards the mounting hole, and the guiding surface is used to guide the pivot shaft to the mounting hole.

In some embodiments of the present disclosure, the mounting base includes a hollowed-out area.

In some embodiments of the present disclosure, two mounting bases are provided and spaced apart from each other, each of the mounting bases includes a mounting hole, and two ends of the pivot shaft are fitted with mounting holes at corresponding sides respectively.

In some embodiments of the present disclosure, the indoor part includes a through slot, in the unlocked state, the fastening member is located in the through slot to enclose the through slot, and in the locked state, the fastening member rotates to an outside of the through slot to fix a position of the window sash.

Reference throughout this specification to "an embodiment," "some embodiments," "illustrative embodiment," "an example," "a specific example," or "some examples," means that a particular feature, structure, material, or characteristic described in connection with the embodiment or example is included in at least one embodiment or example of the present disclosure. Thus, the appearances of the phrases are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure. The scope of the invention is defined by claims and the like.

What is claimed is:

1. A window air conditioner comprising:

a casing comprising an outdoor part and an indoor part spaced apart from each other, a receiving groove being formed between the outdoor part and the indoor part;

an elastic protruding portion provided at a side wall of the receiving groove; and a fastening device mounted at the casing and including a plurality of snapping grooves spaced apart from each other in a direction from the indoor part to the outdoor part, the fastening device being configured to switch between:

a locked state in which the fastening device extends into the receiving groove and one of the plurality of snapping grooves cooperates with the elastic protruding portion to fix a position of the fastening device, and an unlocked state in which the fastening device is outside the receiving groove.

2. The window air conditioner according to claim 1, wherein:

the fastening device includes a recess;

the plurality of snapping grooves are arranged at a bottom wall of the recess; and the elastic protruding portion extends into the recess to be fitted with one of the snapping grooves.

3. The window air conditioner according to claim 1, wherein the fastening device is arranged at a side wall of the indoor part that faces the outdoor part.

4. The window air conditioner according to claim 1, wherein:

the indoor part includes a through slot; and the fastening member is configured to:

be located in the through slot to enclose the through slot when in the unlocked state, and rotate out of the through slot when in the locked state.

5. The window air conditioner according to claim 1, wherein the elastic protruding portion is configured to be snapped into one of the snapping grooves.

6. The window air conditioner according to claim 5, wherein the fastening device includes a plurality of teeth along a side of the fastening device, and each of the snapping grooves is formed between two adjacent ones of the teeth.

7. The window air conditioner according to claim 6, wherein each one of the teeth includes:

a first fitting surface facing the receiving groove and forming a first angle with a reference plane that is tangential to a top of the one of the teeth; and a second fitting surface facing away from the receiving groove and forming a second angle with the reference plane, the first angle being smaller than the second angle.

8. The window air conditioner according to claim 5, wherein the elastic protruding portion comprises:

a mounting portion arranged at the casing and including an elastic member; and a fitting protrusion arranged at an upper surface of the mounting portion.

9. The window air conditioner according to claim 8, wherein the mounting portion comprises:

a first sub-portion and a second sub-portion spaced apart from each other in an up-down direction, wherein the fitting protrusion is arranged at an upper position of the first sub-portion; and a third sub-portion connected between the first sub-portion and the second sub-portion.

10. The window air conditioner according to claim 9, wherein the mounting portion and the casing are integrally formed.

11. The window air conditioner according to claim 8, wherein the fastening device includes a handle at an end portion of the fastening device that faces the receiving groove, the handle being configured to drive the fastening device to move relative to the casing.

12. The window air conditioner according to claim 11, wherein the mounting portion includes a grasping space at a side adjacent to the handle.

13. The window air conditioner according to claim 11, wherein the handle includes a snapping tip at a terminal end of the handle.

14. The window air conditioner according to claim 1, wherein:

the casing includes a mounting base; and the fastening device comprises:

a pivot shaft rotatably arranged at the mounting base; and a fastening member connected to the pivot shaft and including the snapping grooves, the fastening member being configured to rotate relative to the casing.

15. The window air conditioner according to claim 14, wherein the mounting base is configured as an elastic member and includes a mounting hole, and the pivot shaft is in contact with an inner wall of the mounting hole.

16. The window air conditioner according to claim 15, wherein the mounting base includes a hollowed-out area.

17. The window air conditioner according to claim 15, wherein:

the mounting base is a first mounting base and the mounting hole is a first mounting hole;

the casing further includes a second mounting base spaced apart from the first mounting base and including a second mounting hole; and two ends of the pivot shaft are fitted with first mounting hole and the second mounting hole, respectively.

18. The window air conditioner according to claim 15, wherein the mounting base further includes a mounting passage in communication with the mounting hole, and the pivot shaft is mounted in the mounting hole through the mounting passage.

19. The window air conditioner according to claim 18, wherein at least one of opposite walls of the mounting passage includes a guiding surface obliquely extending towards the mounting hole, and the guiding surface is configured to guide the pivot shaft to the mounting hole.

* * * * *